United States Patent [19]

Begg

[11] Patent Number: 4,501,611

[45] Date of Patent: Feb. 26, 1985

[54] POWDER FORGING OF ALUMINUM AND ITS ALLOYS

[75] Inventor: Alan R. Begg, Ascot, England

[73] Assignee: British Petroleum Company, London, England

[21] Appl. No.: 583,107

[22] Filed: Feb. 24, 1984

[30] Foreign Application Priority Data

Mar. 15, 1983 [GB] United Kingdom ..... 8307158

[51] Int. Cl.[3] ..... B22F 9/00

[52] U.S. Cl. ..... 75/0.5 R; 75/251

[58] Field of Search ..... 75/0.5 R, 251; 420/528

[56] References Cited

U.S. PATENT DOCUMENTS 4,150,204 4/1979 Moden et al. ..... 420/528

4,166,755 9/1979 Fister, Jr. ..... 420/528

FOREIGN PATENT DOCUMENTS 1421958 1/1976 United Kingdom .

OTHER PUBLICATIONS

Khuldov, E. A. et al.; *Welding Production,* vol. 23, Sep. 1976; Fluxless Brazing of Aluminum Alloys with Low Temperature Solders Alloyed with Gallium.

Spasskii, A. G. et al.; *Welding Production,* vol. 17, 1970; Fluxless Soldering of Aluminum and Magnesium Alloys.

Novik et al.; *Industrial Laboratory,* 42(5), pp. 780–782, May 1976, Use of Design of Experiments in Developing a Composite Gallium Solder.

*Primary Examiner*—W. Stallard

*Attorney, Agent, or Firm*—Brooks Haidt Haffner & Delahunty

[57] ABSTRACT

This invention relates to (a) a powder of aluminium or an alloy thereof having at least 0.04% w/w of gallium concentrated on the grain boundaries of the particles in the powder, (b) a method of producing the powder by fragmenting a substrate of aluminium or an alloy thereof coated with gallium under a deforming stress, and (c) a method of forging the powder. The powder can be forged into complex shapes using fewer steps than hitherto possible especially with aluminium powders.

10 Claims, No Drawings

POWDER FORGING OF ALUMINUM AND ITS ALLOYS

The present invention relates to a powder of aluminium or its alloy having a gallium coating thereon, a method of producing such powders and a method of powder forging the gallium coated aluminium or aluminium alloy powder.

Powder forging is a metallurgical process in which a metal powder is bound and forged by heating to high temperatures under pressure into a desired solid shape. Powder forging is increasingly used for the production of a wide variety of components. Powder forging has an advantage over conventional forging techniques in that a complex shape may be formed in fewer operations. The technique also permits the use of more complex alloys, which if conventionally processed suffer from the problems of solute segregation.

Aluminium and its alloys are particularly difficult to process in this manner from their powder form because of the relatively stable oxide which forms on the surface of the powder particles.

It has now been found that the problems associated with powder forging aluminium and its alloys may be mitigated by coating the powder particles with a suitable metal capable of removing the aluminium oxide.

Accordingly the present invention is a powder of aluminium or an alloy thereof capable of being powder forged and having at least 0.04% w/w of gallium on the grain boundaries of the particles in the powder.

According to a further embodiment the present invention is a method of fragmenting a substrate of aluminium or an alloy thereof comprising coating the substrate surface with gallium and applying a deforming stress on the coated substrate.

According to yet another embodiment the present invention is a method of powder forging wherein the powder comprises aluminium or an alloy thereof having a coating of gallium thereon.

The powder of aluminium or its alloy suitably has an overall concentration of 0.04% to 5% w/w gallium which lies concentrated on the grain boundaries of the particles in the powder. Typically, the particle size of the powder capable of being powder forged is suitably in the range of 0.5 microns to 250 microns.

The powder of aluminium or its alloy containing gallium may be produced by several techniques.

In one embodiment of the invention, the powder of aluminium or its alloy is coated with gallium by a chemical deposition technique, ie by stirring the powder in a solution of a gallium salt eg gallium nitrate for a duration which is thereafter filtered, washed and dried.

The solution of the gallium salt eg gallium nitrate used is suitably an aqueous solution containing 1% w/w of the salt. The resultant product is a gallium coated powder which can be powder forged into a solid shape by heating under pressure.

In a further embodiment, a powder of aluminium or its alloy having gallium on the grain boundaries may be produced by fragmenting a substrate of aluminium or its alloy. The substrate to be fragmented may be in any shape or form e.g. massive, sheets, rods, pellets or like form. The fragmentation may be achieved by coating the substrate with gallium and deforming the coated substrate. Typically a sheet of fine grained aluminium or its alloy is heated to a temperature between 29° C. (the melting point of gallium) and 60° C. Liquid gallium is then smeared thinly over one or both sides of the sheet. The amount of gallium required to cause embrittlement depends on the metallurgical nature of the aluminium alloy (e.g. grain size) but will be less than 5% of the weight of aluminium. It is necessary to allow the gallium to migrate into the aluminium. This is accomplished by holding the temperature of the sheet at 20°-60° C. The time required for embrittlement depends on the thickness of the sheet for instance for a thin foil (less than 0.1 mm) embrittlement is almost instantaneous. Longer times are required for thicker sheets. A 1.5 mm thick sheet will take from 30 minutes to 1 hour at 30° C. When embrittlement has occurred the tensile ductility of the material is very low (less than 0.5%) and the sheet can be readily crushed or powdered by light deformation. The resultant powder already has a coating of gallium thereon and can be powder forged directly without any additional gallium coating step. Thus both the powdering and gallium coating operation is achieved in a single step.

The amount of gallium by weight that is necessary in relation to the amount of metal powder to be coated is suitably in the range of 0.04 to 5% based on the total weight of aluminium in the powder.

The gallium coated powder may then be forged into a desired solid shape by heating to a high temperature, suitably above 200° C. under elevated pressure.

A feature of the present invention is that the gallium coated powder can be forged into articles under milder and more moderate conditions when compared with those needed for forging uncoated powders. The relatively higher heating required to consolidate uncoated powder can destroy the physical properties of certain alloy types. Moreover, the forged articles produced from gallium coated powders have a homogeneous texture and are not brittle, the gallium having totally diffused into the grains or particles of the powder. In addition, the forged articles have substantially the same bend strength as those produced from uncoated powders.

The technique of powder forging aluminium and its alloys coated with gallium may be applied with equal efficiency for making reinforced composite materials based on aluminium and eg a fibre such as carbon fibre capable of withstanding the forging temperatures above 200° C. The products will give materials similar to a fibre reinforced polymer composite except that it will have a metal matrix.

Moreover, the technique may be used to incorporate powder particles of a second phase material into an aluminium matrix. For instance, mixtures of aluminium alloys and aluminium oxide particles, which are conventionally pressed at high temperatures (eg above 500° C.) can be formed at lower temperatures. This is particularly beneficial if the second phase material or the aluminium alloy matrix lacks stability when subjected to heating.

The product and process of the present invention are specifically illustrated below with reference to the following Examples.

EXAMPLES

1

PREPARATION OF GALLIUM COATED ALUMINIUM POWDER (a) By Embrittlement

A sheet (about 1.5 mm in thickness) was smeared with gallium on both sides. This was heated to 30° C. for two hours to encourage diffusion of gallium to form brittle films along the aluminium grain boundaries. The sheet was then broken up and crushed in a mortar and pestle to give a fine grained powder.

(b) By Chemical Deposition

Pure aluminium powder was stirred into a 1 percent gallium nitrate solution and left overnight to react before being filtered and dried.

2

COMPACTION OF GALLIUM COATED POWDER

Samples of the two types of coated powder produced, and an uncoated aluminium powder, were clamped between steel plates and heat treated for 6 hours at 200° C. The uncoated powder showed no tendency towards bonding. The chemically coated powder showed only modest strength, being friable to the touch and easily broken by hand. The powder produced from gallium embrittlement, however, bonded with greater success giving a sheet of compacted material which could be readily handled.

3

POWDER PREPARATION

Gallium coated alluminium powder was prepared using two different techniques: chemical deposition and grain boundary embrittlement of solid. In the first technique aluminium powder was coated with gallium by stirring it in a 1% solution of gallium nitrate 2% nitric acid at 25° C. for 1 hour. This gave a very thin deposit of gallium on the surface of the grains. The second technique involved embrittling aluminium with gallium at low temperature (less than 60° C.). At these low temperatures gallium selectively migrated along the grain boundaries of the polycrystalline aluminium and formed brittle films. This was then ground to a powder which, because it had fractured along brittle gallium rich areas, consisted of particles with aluminium rich centres coated with a gallium rich surface.

4

FORGING PROCEDURES 1.5 g powder samples were hot pressed in a simple uniaxial double action ram press to produce discs 25 mm in diameter by around 1.5 mm thick. The press used had a temperature limitation of 120° C., so to fully remove the effects of gallium embrittlement of the aluminium a number of the pressed discs were subsequently heated without the application of pressure to 400° C. All specimens were pressed at a load of 30 KN±10%, (equivalent to a pressure of 61 MPa). Both types of gallium coated powders and pure uncoated aluminium powder were pressed.

(a) Mechanical Testing

To measure the mechanical properties of the hot pressed discs, a rectangular strip approximately 7 mm in width was machined from the centre of the discs. These strips were tested in three point bending to determine the failure strength and ductility up to maximum load of the material. The results obtained for each of the various pressing/heating treatment for the three powder types are given in Table 1.

(b) Atomic Absorption Analysis

The gallium content of samples of pressing made from the chemically coated powder and the embrittled powder were determined by atomic absorption analysis. The results are given in Table 2.

It can be seen that the chemically coated powder has less strength than the pure aluminium powder for three of the four pressing conditions used. The gallium content of these three low results was very low (0.008–0.009%). The one case where strength was higher for the chemically coated powder (i.e. that pressed for 24 hours at 120° C.) the gallium content was higher (0.04%).

The powder produced via embrittlement of solid aluminium with gallium showed that on average, for the four comparable conditions of pressing studied, both the strength and ducility of the gallium containing material were around three times as high as those for the pure aluminium.

(c) Metallographic Examinations

Sections and fracture surfaces of powder pressings of the pure aluminium and the embrittlement coated aluminium were studied in the scanning electron microscope (SEM) following pressing for 24 hours at 120° C. and heat treatment at 400° C. for 1 hour.

The results showed a basic difference in powder particles shape: the pure powder was equiaxed largely spherical in shape, the embrittlement coated powder having more tabular elongated grains. The tabular grain morphology arose because the aluminium plate which was embrittled had been cold rolled, causing grain elongation so that when the material was crushed fracturing along grain boundaries flat, platelike grains resulted.

It could also be seen that only a very limited amount of bonding had taken place in the uncoated powder. Both section and fracture surface showed that few sinter necks had developed between adjacent grains: The bonding in the embrittlement coated powder by comparison was extensive. Where powder particles had been adequately brought into intimate contact, complete bonding had resulted.

An SEM photograph in which the contrast had been adjusted such that gallium rich areas showed as pale grey whereas these areas rich in aluminium were darker showed that the gallium was well dispersed, not localised at grain boundaries.

TABLE 1

| Powder | Time at 120° C. | Time at 400° C. | Strength (MPa) | Ductility (%) |
|---|---|---|---|---|
| Pure Aluminium | 1 | 0 | 7 | 0.065 |
| | 24 | 0 | 11 | 0.097 |
| | 1 | 24 | 39 | 0.46 |
| | 24 | 1 | 41 | 0.41 |
| Aluminium with chemically deposited gallium | 1 | 0 | 0 | 0 |
| | 24 | 0 | 17 | 0.165 |
| | 1 | 24 | 29 | 0.29 |
| | 24 | 1 | 28 | 0.29 |
| Aluminium coated with gallium by embrittlement | 1 | 0 | 69 | 0.44 |
| | 24 | 0 | 64 | 0.43 |
| | 1 | 24 | 85 | 1.34 |
| | 24 | 1 | 95 | 1.59 |
| | 72 | 0 | 57 | 0.49 |
| | 72 | 168 | 106 | 1.84 |

TABLE 2

| Powder | Gallium Content |
|---|---|
| Pure Aluminium | 0 |
| Chemically Coated Aluminium | 0.008–0.04% |

TABLE 2-continued

| Powder | Gallium Content |
|---|---|
| Embrittlement Coated Aluminium | 3.5–4% |

I claim:

1. A powder of aluminium or an alloy thereof capable of being powder forged and having at least 0.04% w/w of gallium concentrated on the grain boundaries of the particles in the powder.

2. A method of fragmenting a substrate of aluminium or an alloy thereof comprising coating the substrate surface with gallium and applying a deforming stress on the coated substrate.

3. A method of powder forging wherein the powder comprises aluminium or an alloy thereof having a coating of gallium thereon.

4. A powder according to claim 1 wherein said powder has an overall concentration of 0.04% to 5% w/w gallium concentrated on the grain boundaries of the particles in the powder.

5. A powder according to claim 1 wherein the particle size of the powder capable of being powder forged is in the range of 0.5 microns to 250 microns.

6. A process according to claim 2 wherein a powder of aluminium or its alloy having gallium on the grain boundaries is produced by heating the substrate to a temperature between 29° C. and 60° C., smearing liquid gallium over the substrate to cause embrittlement thereof and applying a deforming stress on the embrittled substrate.

7. A process according to claims 2 or 6 wherein the substrate is a sheet of fine grained aluminium or its alloy.

8. A process according to claim 2 wherein the amount of gallium by weight applied in relation to the amount of metal powder to be coated is in the range of 0.04 to 5% based on the total weight of aluminium in the powder.

9. A method according to claim 3 wherein the gallium coated powder is forged into a desired solid shape by heating to a high temperature above 200° C. under elevated pressure.

10. A method according to claim 3 wherein the powder forged comprises a mixture of a powder of aluminium and its alloys coated with gallium and a fibrous component capable of withstanding the forging temperatures above 200° C.

* * * * *